United States Patent [19]

Angier et al.

[11] 4,184,942

[45] Jan. 22, 1980

[54] NEOMESOPHASE FORMATION

[75] Inventors: Derek J. Angier, Peapack; Harry W. Barnum, Brookside, both of N.J.

[73] Assignee: Exxon Research & Engineering Co., Florham Park, N.J.

[21] Appl. No.: 903,171

[22] Filed: May 5, 1978

[51] Int. Cl.[2] ..... C10C 3/02; C10C 3/08; D01F 9/14

[52] U.S. Cl. ..... 208/44; 208/22; 208/45; 423/447.1; 423/447.4; 423/449

[58] Field of Search ..... 208/44, 45, 22; 423/445, 448, 447.4, 447.6, 449, 447.1; 264/29.1, 29.2; 106/273 R

[56] References Cited

U.S. PATENT DOCUMENTS

| | | | |
|---|---|---|---|
| 3,392,216 | 7/1968 | Otani | 423/447.6 |
| 3,702,054 | 11/1972 | Araki et al. | 423/447.4 X |
| 3,787,541 | 1/1974 | Grindstaff et al. | 423/447.1 |
| 3,919,376 | 11/1975 | Schulz | 423/447.4 X |
| 3,919,387 | 11/1975 | Singer | 423/447.4 X |
| 3,974,264 | 8/1976 | McHenry | 423/447.4 |
| 3,997,654 | 12/1976 | Kolling et al. | 423/447.4 |
| 4,005,183 | 1/1977 | Singer | 423/447.2 |
| 4,017,327 | 4/1977 | Lewis et al. | 106/273 R |

OTHER PUBLICATIONS

Brooks et al., "Chemistry and Physics of Carbon", vol. 4, 1968, pp. 243–268.

*Primary Examiner*—Edward J. Meros
*Attorney, Agent, or Firm*—Joseph J. Dvorak

[57] ABSTRACT

A process for increasing that fraction of an isotropic carbonaceous pitch which is capable of being thermally converted to an optically anisotropic carbonaceous pitch having less than 25 wt. % quinoline insolubles is described. Basically, the pitch is heated at elevated temperatures until spherules visible under polarized light begin to appear. Then heating is terminated and the pitch solvent extracted to provide a solvent insoluble fraction which is capable of being thermally converted to the optically anisotropic pitch.

9 Claims, No Drawings

NEOMESOPHASE FORMATION

BACKGROUND OF THE INVENTION

1. Field of the Invention

This invention relates generally to the formation of carbonaceous pitches particularly useful in the formation of shaped carbon articles, especially carbon fibers. More particularly, this invention relates to improvements in pitch composition, thereby rendering them more suitable for forming optically anisotropic pitches containing less than 25 wt. % quinoline insolubles.

2. Description of the Prior Art

It is well known that optically anisotropic carbonaceous pitches can be used to form a wide variety of carbon artifacts. One carbon artifact of particular commercial interest today is carbon fiber. Hence, although particular reference is made herein to carbon fiber technology, it will be appreciated that this invention has applicability in areas other than carbon fiber formation.

Referring now in particular to carbon fibers, suffice it to say that the use of carbon fibers in reinforcing plastic and metal matrices has gained considerable commercial acceptance where the exceptional properties of the reinforcing composite materials such as their high strength to weight ratios clearly offset the generally high costs associated with preparing them. It is generally accepted that large scale use of carbon fibers as a reinforcing material would gain even greater acceptance in the marketplace if the costs associated with the formation of fibers could be substantially reduced. Thus, the formation of carbon fibers from relatively inexpensive carbonaceous pitches has received considerable attention in recent years.

To date, all high strength, high modulus carbon fibers prepared from pitches are characterized in part by the presence of carbon crystallites preferentially aligned parallel to the fiber axis. This highly oriented type of structure of the carbon fibers has been obtained either by introducing orientation into the precursor pitch fiber by high temperature stretching of the pitch fiber or by first forming a pitch fiber which possesses considerable structure.

In forming the carbon fiber from the pitch material which has a high degree of orientation, generally it has been considered necessary to thermally transform the carbonaceous pitch prior to fiber formation, at least in part, to a liquid crystal or so-called mesophase state. This thermal transformation typically is achieved at temperatures of between about 350° C. to about 500° C. and over exceedingly long time periods. For example, at 350° C., the minimum temperature generally required to convert an isotropic pitch to the mesophase state, at least one week of heating is usually necessary and then the mesophase content of the pitch is only about 40%, the balance being an isotropic material. At higher temperatures, for example at temperatures of about 400° C., at least ten hours of heating are usually necessary to have complete conversion of the isotropic pitch to the mesophase state.

As will be appreciated, a wide variety of complex reaction sequences take place during the thermal treatment of isotropic pitches; and it is these reactions which result in the formation of large parallel aligned lamellar optically anisotropic molecules which are known as mesophase pitch. Indeed, studies have shown that when heating natural or synthetic pitches at temperatures in the range of about 350° to 550° C., small insoluble liquid spheres begin to appear in the pitch which gradually increase in size as the heating is continued over a period of time. Ultimately, the spheres begin to coalesce into large domains which display strong optical anisotropy characteristic of parallel alignment of the liquid crystal phase. This mesophase transformation has been followed quantitatively by polarized light microscopy investigations of solvent extracted samples of thermally treated pitches in which the untransformed isotropic matrix is dissolved in a solvent such as pyridine or quinoline and the insoluble mesophase fraction is recovered by filtration.

More recently it has been discovered that isotropic carbonaceous pitches contain a separable fraction which is capable of being converted very rapidly, indeed generally in less than about 10 minutes and especially in less than 1 minute when heated to temperatures in the range of from about 230° to about 400° C. to a strongly optically anisotropic deformable pitch containing greater than 75% of a liquid crystal type structure. This highly oriented optically anisotropic pitch material formed from only a fraction of an isotropic carbonaceous pitch has substantial solubility in pyridine and quinoline. Consequently, such material has been referred to as neomesophase pitch, the prefix "neo", which is Greek for new, being used to distinguish this anisotropic pitch material from mesophase pitches which are substantially insoluble in pyridine and quinoline. Basically, the neomesophase former fraction of pitch is isolated by solvent extraction of well-known, commercially available graphitizable pitches such as Ashland 240 and Ashland 260. The amount of neomesophase former fraction of the pitch that is separable, however, is relatively low. For example, with Ashland 240, no more than about 10% of the pitch constitutes a separable fraction capable of being thermally converted to neomesophase.

As indicated hereinabove, the amount of time to convert a carbonaceous isotropic pitch at elevated temperatures to the mesophase state is quite lengthy. On the other hand, the separable fraction of the carbonaceous pitch which is capable of being rapidly converted at relatively low temperatures to a deformable pitch that contains greater than 75% of an optically anisotropic material is relatively small.

SUMMARY OF THE INVENTION

It has now been discovered, however, that isotropic carbonaceous pitches can be pretreated in such a manner as to increase the amount of that fraction of the pitch which is separable and capable of being converted very rapidly to a deformable pitch containing greater than 75% and especially greater than 90% of a liquid crystal type structure.

Generally speaking, the present invention contemplates heating a typical graphitizable isotropic carbonaceous pitch at an elevated temperature for a time sufficient to increase the amount of that fraction of the pitch that is capable of being converted to neomesophase and terminating said heating at a point in time when spherules visible under polarized light appear in said pitch and preferably at a point in time which is just prior to the formation of visible spherules in the pitch. It has been found that such heat treatment will increase the amount of neomesophase former material that is separable from said pitch.

Thus, in one embodiment of the present invention, there is provided a process for producing an optically anisotropic deformable pitch containing greater than 75% of a liquid crystalline phase by first heat treating a typical graphitizable carbonaceous isotropic pitch at temperatures below about 450° C. until polarized light microscopic examination of samples of said pitch detect the formation of spherules therein. Thereafter, said pitch is preferably allowed to cool to ambient temperatures and extracted with a suitable organic solvent to leave an insoluble neomesophase former fraction of the pitch, which fraction is capable of being converted in less than 10 minutes at temperatures generally in the range of about 230° C. to 400° C. to an optically anisotropic deformable pitch containing greater than 75% of the liquid crystalline type of structure.

These and other embodiments of the invention will be more clearly apparent from the following detailed description.

DETAILED DESCRIPTION OF THE INVENTION

The term "pitches" used herein includes petroleum pitches, coal tar pitches, natural asphalts, pitches obtained as by-products in the naphtha cracking industry, pitches of high carbon content obtained from petroleum, asphalt and other substances having properties of pitches produced as by-products in various industrial production processes. As will be readily appreciated, petroleum pitch refers to the residuum carbonaceous material obtained from distillation of crude oils and from the catalytic cracking of petroleum distillates. Coal tar pitch refers to the material obtained by distillation of coal. Synthetic pitches generally refers to residues obtained from the distillation of fusable organic substances.

Generally, pitches having a high degree of aromaticity are suitable for carrying out the present invention. Indeed, aromatic carbonaceous pitches having carbon contents of from about 88% to about 96% by weight and a hydrogen content of about 12% by weight to about 4% by weight are generally useful in the process of this invention. While elements other than carbon and hydrogen sources such as sulfur and nitrogen, to mention a few, are normally present in such pitches, it is important that these other elements do not exceed 4% by weight of the pitch, and this is particularly true in forming carbon fibers from these pitches. Also, these useful pitches typically will have a number average molecular weight of the order of from about 300 to 4000.

Another important characteristic of the starting pitches employed in this invention is that these pitches generally have less than 3 wt. %, preferably less than .3 wt. %, and most preferably less than .1 wt. %, quinoline insolubles (hereinafter QI), such as coke, carbon black and the like. The QI of the pitch is determined by the standard technique of extracting the pitch with quinoline at 75° C. In the starting pitches, as indicated, the QI fraction typically consists of coke, carbon black, ash or mineral matter found in the pitches. In forming carbon articles, particularly in forming carbon fibers, it is particularly important that the amount of foreign materials, such as coke and carbon black, be kept at an absolute minimum; otherwise, such foreign matter tends to introduce weaknesses in the fibers and deformities or other irregularities in the carbon articles prepared when using starting pitches having greater than 0.1% foreign materials.

Those petroleum pitches and coal tar pitches which are well known graphitizable pitches have the foregoing requirements and are preferable starting materials for practicing the present invention.

Thus, it should be apparent that commercially available isotropic pitches, particularly commercially available natural isotropic pitches which are known to form a mesophase pitch in substantial amounts, for example in the order of 75% to 95% by weight during heat treatment, are especially preferred inexpensive starting materials in the practice of the present invention.

As stated above, it has been disclosed in copending application Ser. No. 903,172, filed May 5, 1978 that these pitches have a solvent insoluble separable fraction which is referred to as a neomesophase former fraction or "NMF" fraction which is capable of being converted to an optically anisotropic pitch containing greater than 75% of a highly oriented pseudocrystalline material referred to as a neomesophase pitch. Importantly, this conversion is achievable in generally less than 10 minutes and especially in less than 1 minute when the NMF fraction is heated to temperatures in the range of from about 230° C. to about 400° C., and especially about 30° C. above the point where the material becomes liquid.

Thus, in the practice of the present invention, a typical graphitizable isotropic pitch having below about 5 wt. % QI (i.e., coke, carbon minerals and the like) and most preferably below about 0.1 wt. % QI, is heated at temperatures in the range of about 350° to temperatures generally of about 450° C., and certainly no greater than 500° C., for a time at least sufficient to increase the amount of neomesophase former fraction in the pitch and terminating the heating at a point in time when a portion of the pitch is transformed into spherules which are visible under polarized light microscopic examination. Indeed, it is particularly preferred that heating of the pitch be terminated just prior to the point in time in which spherules of liquid crystals would begin to be formed in the isotropic pitch, were heating continued.

Clearly, the preferred heating range will depend upon numerous factors including the composition and nature of the graphitizable isotropic pitch being heated. Generally, such typical carbonaceous isotropic pitches will not produce the observable spherules at temperatures below 350° C. As temperatures are increased, however, above 350° C., particularly, for example, temperatures above 450° C., and indeed temperatures as high as 550° C., carbonization can occur. If fibers are going to be produced from the pitch being treated in accordance with the present invention, it is preferred not to have such carbon particles present. Consequently, the ideal temperature range for heating such carbonaceous pitch will be in the range of about 350° C. to about 480° C. Heating can be conducted at ambient pressures although reduced pressures, for example pressures of about 1 psi to atmospheric pressure, may be employed. So, too, may elevated pressures be employed. Indeed, higher pressures than atmospheric may be used; however, it is particularly preferred to conduct said heating at temperatures in the range of about 380° C. to 450° C. and at pressures in the range of about 1 psi to 20 psi.

As will be readily appreciated, the length of time for heating the carbonaceous pitch will vary depending upon the temperature, pressure, and indeed the composition of the pitch itself. However, for any given pitch the ideal length of time for heating the pitch can be determined by making a series of micrographic observations of a number of samples of the pitch heated isothermally for different time periods and determining at what point mesophase spherules can be observed visually under polarized light at a magnification factor of from 10 to 1000 X. Such pitch can always then thereafter be heated at that temperature range for that length of time or shorter.

As indicated previously, it is particularly preferred to terminate the heating of the pitch at a point in time just short of the transformation of the pitch into spherules which are observable by polarized microscopy. In general, the pitch is heated for from about 1 hour to about 20 hours. For example, with a commercially available carbonaceous isotropic pitch such as Ashland 240, such pitch will be heated, for example, for about 10 to 16 hours at temperatures of about 400° C. before the formation of visible spherules.

As indicated hereinabove, the foregoing process of heating the carbonaceous pitch results in an increase in the neomesophase former fraction of the pitch. In accordance with the present invention, such heating is terminated, however, prior to the formation of a substantial quantity of neomesophase material in the pitch. Thereafter, the heat treated pitch is extracted with organic solvents to separate the neomesophase former fraction in accordance with the techniques outlined in copending application Ser. No. 903,172, filed May 5, 1978, which application is incorporated herein be reference.

Extraction of the pitch can be conducted at elevated temperatures or at ambient temperatures. Generally, the pitch is first permitted to cool to ambient temperatures.

Basically, the so-treated pitch is extracted with an organic solvent system which has a solubility parameter of between about 8.0 and 9.5 and preferably of 8.7 to 9.0 at 25° C. The solubility parameter of a solvent or mixture of solvents is given by the expression $$\delta = \left(\frac{H_v RT}{V}\right)^{\frac{1}{2}}$$

wherein $H_v$ is the heat of vaporization of the material

R is the molar gas constant

T is temperature in °K. and

V is the molar volume.

In this regard, see, for example, J. Hildebrand and R. Scott, "Solubility of Non-Electrolytes", 3rd Edition, Reinhold Publishing Company, New York (1949) and "Regular Solutions", Prentice Hall, New Jersey (1962). The solubility parameters at 25° C. for some typical organic solvents are as follows: benzene, 9.0; toluene, 8.8; xylene, 8.7; cyclohexane, 8.2. Among the foregoing solvents, toluene is preferred. Also, as is well known, the solvent mixtures can be prepared also to provide a solvent system with a desired solubility parameter. Among mixed solvent systems, a mixture of toluene and heptane is preferred with ratios of 85 volume % toluene/15 volume % heptane to 60 volume % toluene/40 volume % heptane being particularly preferred mixed solvent systems for the practice of this invention. Thus, the heat treated isotropic pitch is contacted with an appropriate solvent to isolate and separate the neomesophase former fraction of the pitch.

The amount of solvent used will be sufficient to leave a solvent insoluble fraction which is capable of being thermally converted to greater than 75% optically anisotropic material in less than 10 minutes. Typically, the ratio of organic solvent to pitch will generally be in the range of about 5 ml to 150 ml of solvent per gram of pitch.

A more complete understanding of the process of this invention can be obtained by reference to the following examples which are illustrative only and not meant to limit the scope thereof which is fully expressed in the hereafter appended claims.

EXAMPLE 1

A commercially available petroleum pitch, Ashland 240, was ground, sieved (100 Taylor mesh size) and extracted with benzene at 28° C. in the ratio of 1 gram of pitch per 100 ml of benzene. The benzene insoluble fraction was separated by filtration and dried. The amount of neomesophase former fraction constituted only 7.8% of the entire pitch. This fraction subsequently was subjected to differential thermal analysis (DTA) and thermal gravimetric analysis (TGA) by heating the sample in the absence of oxygen at a rate of 10° C. per minute to a temperature of 350° C. The DTA showed a sintering point of below 350° C. and the TGA showed a weight loss during heat treatment of about 3%. A polished sample of the heated benzene insoluble pitch shows a microstructure under polarized light at a magnification factor of 500× which is indicative of greater than about 95% optically anisotropic neomesophase material.

EXAMPLE 2

In this example, the commercially available Ashland 240 pitch was subjected to a heat cycle treatment in accordance with the present invention. Specifically, the pitch was charged into an autoclave and therein heated, in vacuo, at the following temperatures: 35 minutes at 103° C. to 316° C.; 75 minutes at 316° C. to 420° C.; 60 minutes at 420° C.±3° C. At 385° C., atmospheric pressure was attained. After cooling to room temperature, the autoclave was opened. 97.9% of the charge was recovered. This recovered material was pulverized in an inert atmosphere. Thereafter, samples of this heat-treated pitch were extracted in accordance with the following procedure: A 500 ml round bottom flask was charged with 40 grams of the pulverized heat soaked pitch and 320 ml of reagent grade toluene. This mixture was stirred for 16 to 18 hours at ambient temperature and then filtered through a fritted glass funnel under a nitrogen atmosphere. The filter cake was washed with 80 ml of toluene and transferred back into the flask with 120 ml of fresh toluene. After 4 hours of stirring, the mixture was vacuum filtered and the filter cake was washed once with 80 ml of toluene and once with 80 ml of heptane. The toluene insolubles were dried at 120° C., in vacuo, to a constant weight. This toluene insoluble neomesophase former fraction represented 25% of the pitch. The neomesophase former fraction had a softening point, determined in the absence of oxygen, in the range of 325° C. to 350° C., at which temperature the neomesophase former fraction was converted to greater than 90% neomesophase as determined by polarized light microscopy of a polished sample. Additionally, at 350° C., a TGA of the sample showed a weight loss of only about 0.3%.

EXAMPLE 3

Following the procedure of Example 2, 40 grams of the pulverized heat soaked pitch was treated in an identical manner but with a mixed solvent consisting of 70 volume % toluene and 30 volume % heptane. After drying to constant weight, the yield of the neomesophase solvent insoluble fraction was 40% of the pitch. This fraction had a softening point in the temperature range of 300° C. to 325° C., at which temperature greater than 85% of optically anisotropic neomesphase was formed.

EXAMPLE 4

Following the general procedure outline in Example 2, a petroleum pitch was heat soaked at 420° C. for 60 minutes and thereafter subjected to an extraction process outlined in Examples 2 and 3. The solvents used and the results obtained are given in Table I below. Also shown in Table I are the results observed after heating these materials to 400° C. and determining the neomesophase content after the sample cooled to ambient temperature. Finally, samples which were heated in a spinning die and spun into fibers were examined under polarized light as well.

TABLE I

| Run | Solvent | Vol. % | Wt. % Solvent Insoluble Fraction | Softening Range °C. Insoluble Fraction | % Neo-Mesophase | % Neomesophase, Spun Fiber |
|---|---|---|---|---|---|---|
| A | toluene | 100% | 30.0 | 325–350 | >90 | 100% |
| B | toluene/heptane | 85/15 | 34.3 | 325–350 | >90 | 100% |
| C | toluene/heptane | 70/30 | 39.9 | 300–325 | >50 | 100% |
| D | toluene/heptane | 60/40 | 42.3 | 275–300 | 0 | >60% |

Apparently the material from Run D was too viscous as it cooled from 400° C. and hence neomesophase failed to develop; nonetheless, the short heating time in the spinning die and subsequent orientation during spinning resulted in formation of significant amounts of neomesophase material.

EXAMPLE 5

Two chemical pitches, one having a softening point of 133° C. and another having a softening point of 166° C., were heat soaked as described in Example 2 above and thereafter extracted with a binary solvent system consisting of 70 volume % toluene and 30 volume % heptane as described in Example 3. For comparative purposes, samples of the pitch which had not been thermally treated in accordance with this invention had also been extracted with the same solvent system. The conditions and results of the test are given in Table II below.

TABLE II

| Run | Pitch Softening Point, °C. | Heat Soak Temp. °C. | Heat Soak Min. at Temp. | Wt. % Toluene Insoluble (Softening Range °C.) | Wt. % Quinoline Insolubles |
|---|---|---|---|---|---|
| E | 130 | None | | 8.55 (375–400) | 0.0 |
| F | 130 | 395 | 70 | 31.4 (400–425) | 0.0 |
| G | 166 | None | | 12.1 (400) | 0.0 |
| H | 166 | 400 | 70 | 48.2 (425) | 0.6 |

What is claimed is:

1. In a process of preparing an optically anisotropic deformable pitch by treating a carbonaceous isotropic pitch with an organic solvent system having a solubility parameter between 8.0 and 9.5, said solvent being in an amount sufficient to provide a solvent insoluble fraction which is capable of being converted into an optically anisotropic pitch having greater than 75% of a liquid crystalline phase in less than 10 minutes when heated at about 30° C. above the point where the material becomes liquid, the improvement comprising heating the isotropic carbonaceous pitch before treatment with said organic solvent system at temperatures in the range of about 350° C. to 450° C. for a time sufficient to increase the solvent insoluble fraction of the pitch and thereafter terminating said heating.

2. The process of claim 1 wherein said heating is terminated just prior to the point in time when spherules would be visible upon polarized light microscopic examination of samples of the pitch.

3. The improvement of claim 2 wherein said heating is conducted at a temperature in the range of about 350° C. to 480° C.

4. The improvement of claim 3 wherein said heating is conducted at pressures of 1 psi to 20 psi and at temperatures of from about 380° C. to 450° C.

5. The process of claim 4 wherein said heating is continued for from about 1 hour to about 20 hours.

6. A process for preparing carbonaceous pitch containing greater than 75% of an optically anisotropic oriented phase having less than about 25 wt. % quinoline insolubles comprising heating a carbonaceous isotropic pitch containing less than 5 wt. % quinoline insolubles at a temperature in the range of from about 350° C. to about 480° C. until polarized light microscopic examination of samples of said pitch indicates the formation of spherules therein; thereafter terminating said heating and extracting said carbonaceous isotropic pitch with an organic solvent system selected from organic solvents and mixtures thereof, said organic solvent system having a solubility parameters of between about 8.0 to about 9.5, the ratio of said organic solvent system to said isotropic carbonaceous pitch being sufficient to provide a solvent insoluble fraction which is capable of being thermally converted to a pitch containing greater than 75% of an optically anisotropic phase in a time less than 10 minutes when said pitch is heated at about 30° C. above the point where the material becomes liquid; separating said solvent insoluble fraction from said solvent system; drying said separated solvent insoluble fraction; and thereafter heating said dried solvent insoluble fraction at a temperature in the range of from about 230° C. to about 400° C., whereby said solvent insoluble fraction is converted to a pitch containing greater than 75% of an optically anisotropic oriented phase and less than about 25 wt. % quinoline insolubles.

7. The process of claim 6 wherein said heated pitch is first allowed to cool to ambient temperatures before extracting said solvent system.

8. An improved process for converting an isotropic carbonaceous pitch to an optically anisotropic deformable carbonaceous pitch comprising:

(a) selecting a graphitizable carbonaceous pitch containing less than 0.3 wt. % of substances which are insoluble in boiling quinoline;

(b) determining for said pitch the point in time at which spherules visible under polarized light begin to appear in said pitch when heated isothermally at a selected temperature in the range of about 350° C. to 480° C. by heating each of a plurality of samples of said pitch isothermally at said selected temperature but for different time periods and then examining said samples under polarized light at a magnification factor of from about 10 to about 1000;

(c) thereafter heating said isotropic pitch at a temperature in the range of from about 350° C. to about 480° C. for a time sufficient to increase that fraction of the pitch which is insoluble in an organic solvent system having a solubility parameter between 8.0 and 9.5 and less than the time in which visible spherules begin to appear as determined in step (b);

(d) extracting said heated pitch with an organic solvent system having a solubility parameter at 25° C. of between 8.0 and 9.5 in an amount sufficient to provide a solvent insoluble fraction of said pitch which when heated to a temperature in the range of from about 230° C. to about 400° C. is converted to a pitch containing greater than 75% of an optically anisotropic phase and 25 wt. % or less of which pitch is insoluble in boiling quinoline.

9. The process of claim 1 wherein said heating is terminated at a point in time when spherules are visible in the pitch under polarized light.

* * * * *

UNITED STATES PATENT OFFICE
CERTIFICATE OF CORRECTION

PATENT NO. : 4,184,942

DATED : January 22, 1980

INVENTOR(S) : Derek J. Angier et al

It is certified that error appears in the above-identified patent and that said Letters Patent are hereby corrected as shown below:

Column 5, lines 41 to 44, the equation for the solubility parameter should appear as follows:

$$\delta = \left(\frac{H_v - RT}{V}\right)^{1/2}$$

Signed and Sealed this

*Twenty-seventh* Day of *May 1980*

[SEAL]

*Attest:*

SIDNEY A. DIAMOND

*Attesting Officer*

*Commissioner of Patents and Trademarks*